US009145785B2

(12) United States Patent
Bidkar et al.

(10) Patent No.: US 9,145,785 B2
(45) Date of Patent: Sep. 29, 2015

(54) AERODYNAMIC SEAL ASSEMBLIES FOR TURBO-MACHINERY

(75) Inventors: Rahul Anil Bidkar, Niskayuna, NY (US); Christopher Wolfe, Niskayuna, NY (US); Biao Fang, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 248 days.

(21) Appl. No.: 13/040,474

(22) Filed: Mar. 4, 2011

(65) Prior Publication Data

US 2012/0223483 A1 Sep. 6, 2012

(51) Int. Cl.

*F01D 11/06* (2006.01)
*F01D 11/04* (2006.01)
*F01D 11/02* (2006.01)

(52) U.S. Cl.

CPC ..... *F01D 11/04* (2013.01); *F01D 11/025* (2013.01)

(58) Field of Classification Search

CPC ..... F01D 11/02; F01D 11/001; F01D 11/025; F01D 11/003; F01D 11/04; F01D 11/08; F01D 11/00; F01D 11/006; F01D 11/14; F01D 11/005; F01D 11/12; F01D 11/18

USPC ..... 277/644, 647, 648, 650, 653, 654, 626, 277/627; 415/135, 138, 173.3, 173.2

See application file for complete search history.

(56) References Cited

U.S. PATENT DOCUMENTS

| | | | | |
|---|---|---|---|---|
| 3,575,432 | A * | 4/1971 | Taylor | 285/367 |
| 5,632,493 | A | 5/1997 | Gardner | |
| 6,505,837 | B1 | 1/2003 | Heshmat | |
| 6,527,274 | B2 | 3/2003 | Herron et al. | |
| 7,261,300 | B2 | 8/2007 | Agrawal et al. | |
| 7,435,049 | B2 * | 10/2008 | Ghasripoor et al. | 415/173.3 |
| 7,451,989 | B1 * | 11/2008 | Cornett et al. | 277/626 |
| 7,530,574 | B2 * | 5/2009 | Lah | 277/314 |
| 7,682,490 | B2 * | 3/2010 | Lah | 202/242 |
| 2008/0143059 | A1 * | 6/2008 | Lah | 277/653 |
| 2008/0265513 | A1 | 10/2008 | Justak | |
| 2008/0309019 | A1 | 12/2008 | Wolfe et al. | |
| 2010/0143101 | A1 | 6/2010 | Fang et al. | |

FOREIGN PATENT DOCUMENTS

JP 62243901 A * 10/1987 ..... F01D 11/08

OTHER PUBLICATIONS

Salehi et al., "Performance of a Complaint Foil Seal in a Small Gas Turbine Engine Simulator Employing a Hybrid Foil/Ball Bearing Support System", Tribology Transactions, Jul. 2001.

"Compliant Foil Seals (CFS)", Mohawk Innovative Technology, Inc., Product Catalogue.

Search Report from corresponding EP Application No. 11194444.3 dated Mar. 17, 2014.

* cited by examiner

*Primary Examiner* — Gilbert Lee
(74) *Attorney, Agent, or Firm* — Ann M. Agosti

(57) ABSTRACT

The present application provides an aerodynamic seal assembly for use with a turbo-machine. The aerodynamic seal assembly may include a number of springs, a shoe connected to the springs, and a secondary seal positioned about the springs and the shoe.

8 Claims, 2 Drawing Sheets

AERODYNAMIC SEAL ASSEMBLIES FOR TURBO-MACHINERY

STATEMENT REGARDING FEDERALLY SPONSORED RESEARCH & DEVELOPMENT

This invention was made with Government support under contract number DE-FC26-05NT42643 awarded by the U.S. Department of Energy. The Government has certain rights in the invention.

TECHNICAL FIELD

The present application relates generally to seal assemblies for turbo-machinery and more particularly relates to advanced aerodynamic seal assemblies and systems for sealing rotor/stator gaps and the like.

BACKGROUND OF THE INVENTION

Various types of turbo-machinery, such as gas turbine engines, are known and widely used for power generation, propulsion, and the like. The efficiency of the turbo-machinery depends in part upon the clearances between the internal components and the leakage of primary and secondary fluids through these clearances. For example, large clearances may be intentionally allowed at certain rotor-stator interfaces to accommodate large, thermally-induced, relative motions. Leakage of fluid through these gaps from regions of high pressure to regions of low pressure may result in poor efficiency for the turbo-machinery. Such leakage may impact efficiency in that the leaked fluids fail to perform useful work.

Different types of sealing systems thus are used to minimize the leakage of fluid flowing through turbo-machinery. The sealing systems, however, often are subject to relatively high temperatures, thermal gradients, and thermal expansion and contraction during various operational stages that may increase or decrease the clearance therethrough. For example, interstage seals on gas turbines and the like may be limited in their performance as the clearances change from start-up to steady state operating conditions. Typical sealing systems applied to such locations include labyrinth seals and brush seals. In the case of labyrinth seals, clearances may be set with a predetermined increased margin so as to avoid contact therewith. This extra clearance, which is useful during the start-up phase of operation, may reduce the efficiency and performance of the turbo-machinery as the leakage increases across the seal during the steady-state phase of operation. Moreover, such labyrinth seals typically are intolerant of changes in the radial clearance of the rotating shaft.

There is thus a desire for improved sealing assemblies and systems for use with turbo-machinery. Preferably such sealing assemblies and systems may provide tighter sealing during steady state operations while avoiding rubbing, wear caused by contact, and damage during transient operations. Such sealing assemblies and systems should improve overall system efficiency while being inexpensive to fabricate and providing a long lifetime.

SUMMARY OF THE INVENTION

The present application and the resultant patent thus provide an aerodynamic seal assembly for use with a turbo-machine. The aerodynamic seal assembly may include a number of springs, a shoe connected to the springs, and a secondary seal positioned about the springs and the shoe.

The present application and the resultant patent further provide a method of sealing between a stationary component and a rotating component. The method may include the steps of rotating a shoe in a first direction, rotating a secondary seal in a second direction so as to contact the shoe, maintaining the shoe in an equilibrium position during aerostatic operation, and moving the shoe away from the rotating component during aerodynamic operation.

The present application and the resultant patent further provide a seal system for use with a turbine engine. The seal system may include a stationary component, a rotating component, and a number of seal assemblies positioned about the stationary component and facing the rotating component. The seal assemblies each may include a shoe with a convergent shape.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
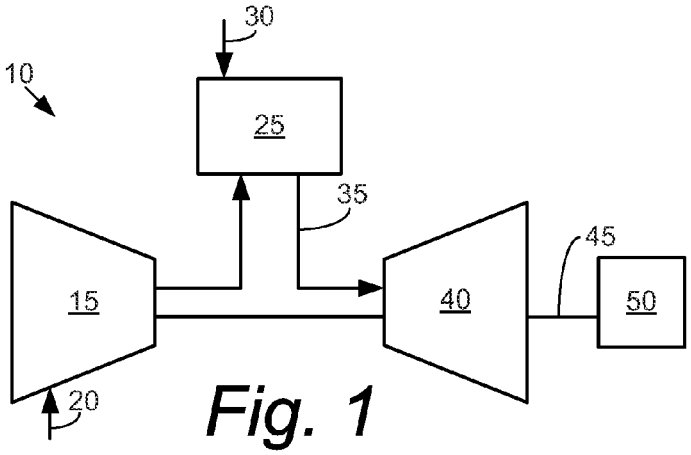
FIG. 1 is a schematic view of a gas turbine engine.

Referring now to the drawings, in which like numerals refer to like elements throughout the several views, FIG. 1 shows a schematic view of gas turbine engine such as a turbo-machine 10 as may be described herein. The turbo-machine 10 may include a compressor 115. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture create a flow of combustion gases 35. Although only a single combustor 25 is shown herein, the gas turbine engine 10 may include any number of combustors 25. The flow of combustion gases 35 is in turn delivered to a turbine 40. The flow of combustion gases 35 drives the turbine 40 so as to produce mechanical work. As described above, the mechanical work produced in the turbine 40 drives the compressor 15 via a shaft 45 and an external load 50 such as an electrical generator and the like.

The turbo-machine 10 may use natural gas, various types of syngas, and/or other types of fuels. The turbo-machine 10 may be any one of a number of different gas turbine engines offered by General Electric Company of Schenectady, N.Y. and the like. The turbo-machine 10 may have different configurations and ma use other types of components. Other types of gas turbine engines also may be used herein. Multiple gas turbine engines, other types of turbines, and other types of power generation equipment also may be used herein together.

Figure 2:
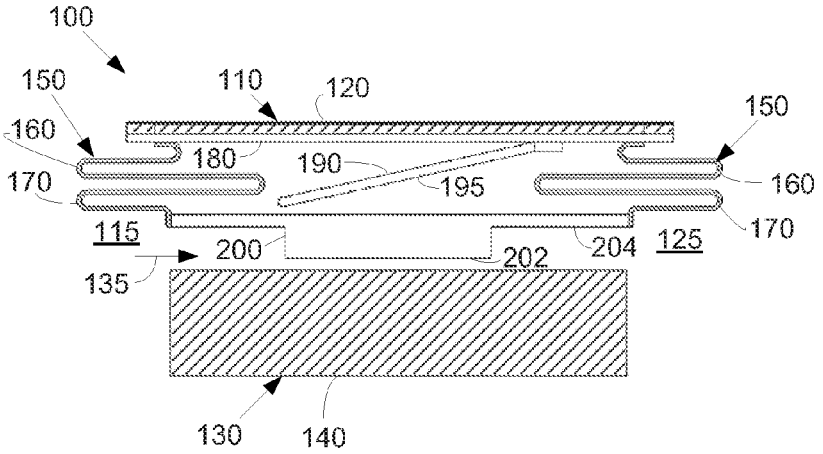
FIG. 2 is a side plan view of an aerodynamic seal assembly as may be described herein.

FIG. 2 shows an example of an aerodynamic seal assembly 100 as may be described herein. Similarly to that described above, the aerodynamic seal assembly 100 seals between a stationary component 110 such as a stator 120 and the like and a rotating component 130 such as a rotor 140 and the like. The aerodynamic seal assembly 100 may be used with any type of stationary components 110 and rotating components 130.

Other configurations and other components may be used herein. The aerodynamic seal assembly 100 may be positioned between a high pressure side 115 and a low pressure side 125 to seal a flow of fluid 135 therebetween.

The aerodynamic seal assembly 100 may include a number of springs 150. In this example, the springs 150 may be in the form of a pair of bellows 160 with a number of folds 170 therein. Other types of springs 150 in other configurations also may be used herein. The stiffness or compliance of the springs 150 and the pressure resisting capability of the springs 150 may vary. The bellows 160 may be fabricated from high strength, creep resistant nickel-chrome based alloys such as Inconel X750, nickel based alloys such as Rene 41, and the like. The springs 150 may be attached at one end to a top piece 180. The springs 150 may be attached by welding, brazing, and other types of attachment means. The top piece 180 may be attached to the stator 120 or other type of stationary component 110 through the use of hooks (not shown) and other types of connection means.

The aerodynamic seal assembly 100 also may include a secondary seal 190. The secondary seal 190 may be attached to the top piece 180. The secondary seal 190 may extend downwards as will be described in more detail below. The secondary seal 190 may be attached by welding, brazing, and other types of attachment means. The secondary seal may have a largely plate-like shape 195. The secondary seal may be fabricated from high strength, high creep resistant nickel chrome-based alloys such as Inconel X750, nickel-based alloys such as Rene 41, and the like. The secondary seal 190 blocks airflow therethrough and also acts as a spring as will be described in more detail below.

The aerodynamic seal assembly 100 also includes a shoe 200 connected to the springs 150. The shoe 200 may be attached by welding, brazing, and other types of attachment means. As is seen in FIG. 2, the shoe 200 extends from an upstream edge to a downstream edge with a thicker middle 202 and a pair of thinner ends 204 forming a substantially convergent wedge like shape 210 with the thicker middle portion 202 interfacing with the rotor 150. The shoe 200 may be made from fatigue-resistant metals with strong mechanical strength.

Figure 3:
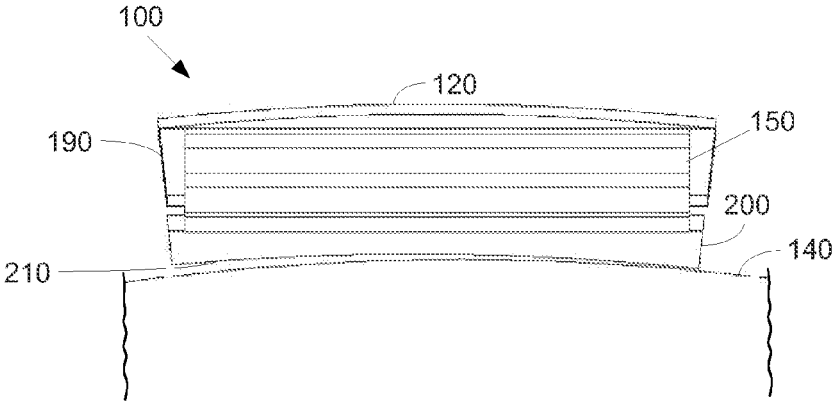
FIG. 3 is a front plan view of the aerodynamic seal assembly of FIG. 2.

As is shown in FIG. 3, the shoe 200 may have a width somewhat larger than that of the springs 150 so as to allow for airflow around the springs 150 and to ensure equal air pressure on either side of the springs 150. This equal pressure on either side of springs 150 allows the springs 150 to perform the functions of (a) guiding the radial motion of the shoe 200 and (b) providing radial and axial stiffness for the shoe motion without any interference from the air flow patterns around the springs 150. Thus, the pressure loading across the seal 100 is mainly resisted by the secondary seal 190 such that the springs 150 are relieved of the extra function of resisting the pressure load. Because the springs 150 do not have to resist any significant pressure load, the bellow spring thickness does not have to be large for resisting the pressure load. This feature of small bellow spring thickness allows the bellow springs 160 to undergo large deformations with small flexural stresses well below the bellow spring material strength capability, thereby enabling large radial shoe movement capabilities. Thus, keeping the bellow spring width 150 smaller than the width of the shoe 200 (as seen in FIG. 3) allows for pressure equalization across the bellows 160, which in turn allows the use of thin bellow springs capable of accommodating large radial movements of the shoe 200.

As seen in FIG. 3, the springs 150 and the secondary seal 190 are largely straight in the tangential direction (direction of rotation of the rotor). As such, the stresses may be minimized even during large deformation of the springs 150 and the secondary seal 190 during transient operations.

The secondary seal 190 and the shoe 200 may or may not have an initially open gap as shown in FIG. 2. The amount of a possible initial gap between the secondary seal 190 and the shoe 200 is determined by several factors including the stiffness of the secondary seal 190, the stiffness of the springs 150 and the pressure loading on the shoe 200, which might cause the initially open gap to close.

The convergent wedge like shape 210 may be achieved through an intentional curvature mismatch with the rotor 140. The convergent wedge like shape 210 may be machined into the shoe 200. A convergent-divergent shape in the direction of circular rotor motion also may be used herein. Other types of fabrication techniques may be used herein. Other components and other configurations may be used herein.

The primary function of the of the convergent-divergent or convergent wedge shape 210 is to form a squeeze film of fluid between the shoe 200 and the rotor 140 so as to generate large fluid pressures by a squeeze action and similar thin film fluid physics. The inner surface of the shoe 200 (facing the rotor 140) and the outer face of the rotor 140 (facing the shoe 200) should have a good surface finish with a surface roughness value approximately ten to fifteen times smaller than the smallest expected fluid film thickness between the shoe 200 and the rotor 140. The rotor and the shoe surfaces also may be coated with wear-resistant coatings (with appropriate surface finish as mentioned above) such as a chrome-carbide for the rotor and PS304 (a high temperature ceramic lubricant developed by NASA) for the shoe 200. Other materials may be used herein.

Figure 4:
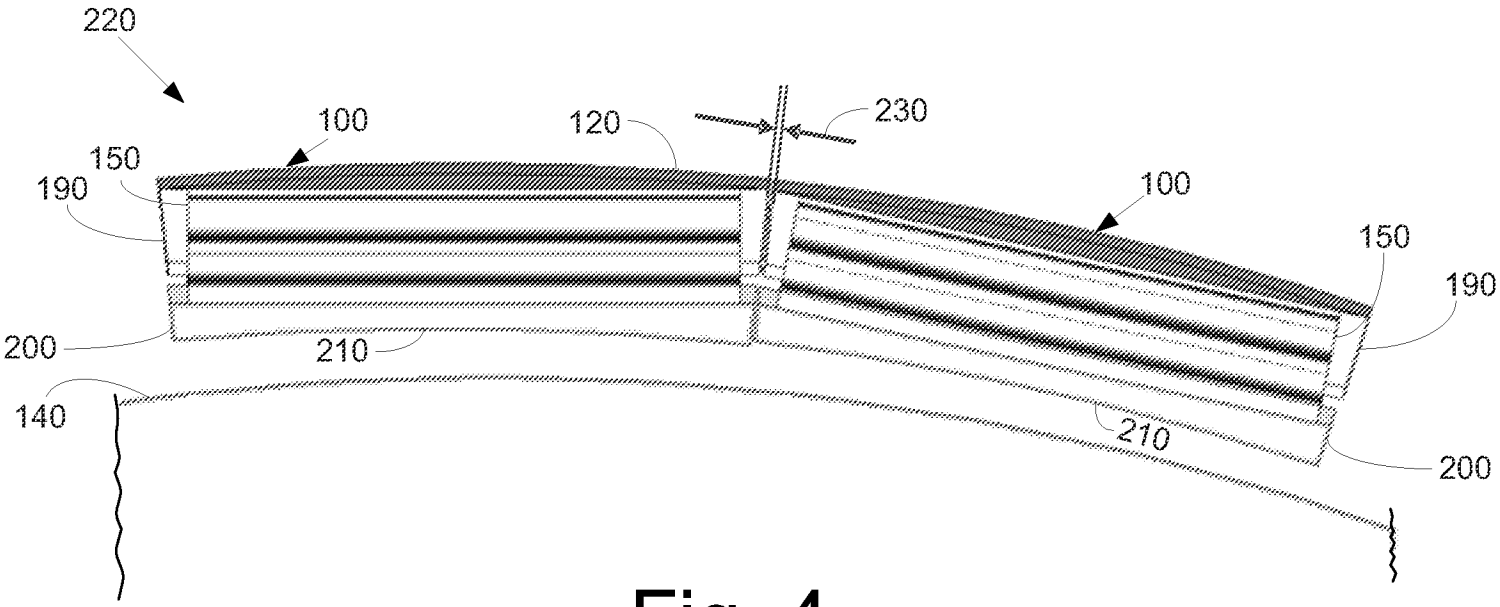
FIG. 4 is a front plan view of a portion of an aerodynamic seal system as may be described herein.

FIG. 4 shows an aerodynamic seal system 220 as may be described herein. The aerodynamic seal system 220 may include a number of aerodynamic seal assemblies 100 or segments positioned about a periphery of the rotor 140 or other type of rotating component 130. Any number of aerodynamic seal assemblies 100 or segments may be used herein. An intersegment gap 230 may be positioned between neighboring seal assemblies 100 or segments. The intersegment gap 230 allows each of the seal assemblies 100 to move independently of the neighboring assemblies 100. The intersegment gap 230 is a direct opening from the high pressure side 115 to the low pressure side 125. The intersegment gap leakage may be minimized by (a) suitably minimizing the length of the secondary seal 190 while simultaneously considering its stiffness and pressure-load resisting capacity and (b) accurately fabricating neighboring seal assemblies 100 or segments with a process such as wire EDM so that a small intersegment gap may be reliably maintained between neighboring segments. Other components and other configurations may be used herein.

In use, aerostatic forces on the shoe 200 during steady state operations caused by air flow patterns around the shoe 200 tend to push the shoe 200 away from the rotor 140 while the springs 150 and the secondary seal 190 tend to push the shoe 200 towards the rotor 140. The shoe 200 attains an equilibrium position relative to the rotor 140 depending upon a balance of various fluids and structural forces. The equilibrium position during aerostatic operation mode is such that the thin fluid film exists between the shoe 200 and the rotor 140. The shoe 200 moves radially away from the rotor 140 while simultaneously rotating rotate clockwise (as in FIG. 2) under the influence of fluid loads and spring forces. On the other hand, the secondary seal 190 flexes radially towards the rotor 140 and, in doing so, applies a contact force on the shoe 200. In the current example, the location of this contact force is such that it causes a radial motion of the shoe 200 towards the rotor 140 along with a counterclockwise rotation of the shoe 200 (as shown in FIG. 2). (The respective directions may vary.)

The clockwise and counterclockwise movements described above may balance one another so as to result in the shoe equilibrium position largely parallel to the rotor 140 during aerostatic operation. Other shoe equilibrium positions that are non-parallel to the rotor 140 also may be achieved by changing the relative axial positions of the springs 150, the axial position of the secondary seal 190, the axial location of the thicker portion 202 of the shoe 200 interfacing with the rotor, the stiffness of the springs, the stiffness of the secondary seal, and the like.

During a rotor transient, either the rotor radius increases due to thermal growth of the rotor 140 or the stator 120 moves radially towards the rotor 140. Both actions result in a reduction of the fluid film gap between the shoe 200 and the rotor 140. When the fluid film gap reduces to a small number (approximately of the order of one thousandths of an inch or smaller), the seal 100 operates in the aerodynamic mode of operation. When the fluid film thickness reduces, the aerodynamic forces on the thicker portion 202 of the shoe 200 increase due to rotor speed and the convergent 210 or convergent-divergent wedge shape thereof so as to cause the shoe 200 to move radially away from the rotor 140. This movement away from the rotor 140 allows the rotor 140 to expand while avoiding contact therewith.

Because the thin fluid film, the rotation speed, and the wedge-like shape of the film can generate large aerodynamic forces, the shoe 200 may be pushed radially outwards against the structural resistance of the springs 150 and the secondary seal 190. The shoe 200 thus may move radially outwards and accommodate large relative motion between the rotor 140 and the stator 120 without contact between the shoe 200 and the rotor 140. This non-contact and self-adaptive behavior of the seal assembly 100 thus provides for the long-life and sustained leakage performance where the rotor-stator relative motion during the transient may be poorly characterized.

Control of the intersegment gaps 230 may be provided by changing either the length of the secondary seal 190 or changing the spacing between neighboring seal assemblies 100 or segments. Specifically, overall intersegment leakage may be reduced by reducing the length of the secondary seal 190 and providing a small intersegment gap 230.

The aerodynamic seal assembly 100 described herein thus provides good sealing during steady state operation by maintaining a small radial clearance between the rotor 140 and the shoe 200. Likewise, the aerodynamic seal assembly 100 also acts as a moveable spring so as to move out of the way of the rotor 140 by generating additional aerodynamic loads during transient operations. Specifically, the convergent 210 or convergent/divergent shape machined into the shoe 200 generates additional aerodynamic loads during transient operations. The seal assembly 100 thus maintains an air film between the shoe 200 and the rotor 140 so as to ensure no contact or rubbing therebetween.

During both aerostatic and aerodynamic operations, the secondary seal 190 may flex radially downwards so as to touch the shoe 200 at all times. Once the secondary seal 190 contacts the shoe 200, the seal 190 blocks the majority of the fluid flowing from upstream to downstream (except the intersegment leakage) between the top piece 180 and the shoe 200. The secondary seal 190, thus acts like a seal. Furthermore, once in contact with the shoe 200, the secondary seal 190 exerts a contact force on the shoe 200. Any radial movement of the shoe 200 (caused by the aerostatic and aerodynamic fluid loads) can occur only after overcoming the resistance of not only the springs 150 but also the resistance offered by the secondary seal 190 in the form of the contact force. The secondary seal 190 thus also acts as both a seal and a spring.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. An aerodynamic seal assembly positioned between a stationary component and a rotating component of a turbomachine, comprising:

a plurality of springs coupled to a top piece;

a shoe connected to the plurality of springs; and a secondary seal coupled to the top piece and positioned about the plurality of springs and the shoe, wherein the secondary seal acts as a spring and as a seal that blocks a fluid flowing between the top piece and the shoe, wherein a curvature around the rotating component has a mismatch with a curvature of the shoe such that a convergent-divergent or a convergent squeeze fluid film forms between the shoe and the rotating component during rotation of the rotating component to prevent contact of the shoe and the rotating component.

2. The aerodynamic seal assembly of claim 1, wherein the plurality of springs comprises a plurality of bellows.

3. The aerodynamic seal assembly of claim 1, wherein the plurality of springs comprises a plurality of folds.

4. The aerodynamic seal assembly of claim 1, wherein the top piece is attached to the stationary component.

5. The aerodynamic seal assembly of claim 1, wherein the plurality of springs comprises a first width and the shoe comprises a second width and wherein the first width is less than the second width.

6. The aerodynamic seal assembly of claim 1, wherein the plurality of springs and the secondary seal comprise a nickel based or a nickel-chrome based alloy.

7. The aerodynamic seal assembly of claim 1, wherein the secondary seal comprises a plate.

8. The aerodynamic seal assembly of claim 1, wherein the secondary seal is configured to resist pressure load across said seal assembly.

* * * * *